US011435046B2

(12) United States Patent
Renaud et al.

(10) Patent No.: US 11,435,046 B2
(45) Date of Patent: Sep. 6, 2022

(54) ILLUMINATION SYSTEM FOR A LIGHTING AND/OR SIGNALLING DEVICE OF A MOTOR VEHICLE

(71) Applicant: VALEO VISION, Bobigny (FR)

(72) Inventors: Pierre Renaud, Bobigny (FR); Benoit Delande, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/277,620

(22) PCT Filed: Sep. 17, 2019

(86) PCT No.: PCT/EP2019/074907
§ 371 (c)(1),
(2) Date: Mar. 18, 2021

(87) PCT Pub. No.: WO2020/058289
PCT Pub. Date: Mar. 26, 2020

(65) Prior Publication Data

US 2021/0348732 A1 Nov. 11, 2021

(30) Foreign Application Priority Data

Sep. 19, 2018 (FR) ..... 18 58477

(51) Int. Cl.
*F21S 41/153* (2018.01)
*F21S 41/24* (2018.01)
(Continued)

(52) U.S. Cl.
CPC ..... *F21S 41/153* (2018.01); *F21S 41/143* (2018.01); *F21S 41/24* (2018.01); *F21S 41/29* (2018.01); *F21Y 2115/10* (2016.08)

(58) Field of Classification Search
CPC ..... F21S 41/153; F21S 41/24; F21S 41/143; F21S 41/29; F21Y 2115/10
See application file for complete search history.

(56) References Cited

U.S. PATENT DOCUMENTS

2008/0253144 A1* 10/2008 Dolson ..... B60Q 1/0041 362/547
2010/0226142 A1* 9/2010 Brendle ..... F21S 41/285 362/512
(Continued)

FOREIGN PATENT DOCUMENTS

CN 107525005 A 12/2017
EP 1 925 876 A1 5/2008
(Continued)

OTHER PUBLICATIONS

International Search Report dated Jan. 13, 2020 in PCT/EP2019/074907 filed on Sep. 17, 2019, citing references, 2 pages.
(Continued)

*Primary Examiner* — Andrew J Coughlin
*Assistant Examiner* — Jessica M Apenteng
(74) *Attorney, Agent, or Firm* — Oblon, McClelland, Maier & Neustadt, L.L.P.

(57) ABSTRACT

Lighting module of a lighting and/or signalling device for a motor vehicle including at least one light source positioned on a source support, an optical element comprising an input face which receives light rays emitted by said at least one light source and is positioned facing the latter, and a frame supporting the optical element and fastened to said source support. The optical element has at least one stud having a free end projecting towards the source support, said at least one stud being made of the same material as the optical element and being in direct or indirect contact with the source support when the lighting module is assembled.

20 Claims, 4 Drawing Sheets

(51) Int. Cl.

| | |
|---|---|
| ***F21S 41/143*** | (2018.01) |
| ***F21S 41/29*** | (2018.01) |
| ***F21Y 115/10*** | (2016.01) |

(56) References Cited

U.S. PATENT DOCUMENTS

| | | | | |
|---|---|---|---|---|
| 2011/0141742 | A1* | 6/2011 | Tanaka | F21V 29/75 362/294 |
| 2015/0323147 | A1* | 11/2015 | Kanayama | F21V 11/16 362/487 |

FOREIGN PATENT DOCUMENTS

| | | | |
|---|---|---|---|
| EP | 3 339 720 | A1 | 6/2018 |
| FR | 3 056 700 | A1 | 3/2018 |
| JP | 2015-195377 | A | 11/2015 |
| WO | 2018/065278 | A1 | 4/2018 |

OTHER PUBLICATIONS

English translation of Office Action dated Jun. 10, 2022 issued in corresponding Japanese patent application 2021-515081.

* cited by examiner

ILLUMINATION SYSTEM FOR A LIGHTING AND/OR SIGNALLING DEVICE OF A MOTOR VEHICLE

The invention relates to the field of lighting and/or signalling, notably for motor vehicles. More particularly, the invention relates to a lighting module of a lighting and/or signalling device for a motor vehicle.

Motor vehicles are equipped with headlights for illuminating the road in front of the vehicle so that the driver can see the road when the external light level is reduced, notably at night. A headlight comprises a housing and a transparent outer lens for sealing the housing. A lighting module comprising a light source and an optical element is arranged in the housing. The light source emits light rays towards an input face of the optical element which shapes said light rays. The optical module may be used to shape, on the basis of the light rays emitted by the light source, a final light beam with a precise light distribution, which is projected on to the road through the sealing outer lens of the headlight.

It is important for the light distribution of the final light beam to be controlled. Notably, it must conform to the current regulations and must not dazzle the various road users, such as the drivers of oncoming or preceding vehicles.

It is therefore essential for the light source to be correctly positioned relative to the input face of the optical element, so that the light rays emitted by the light source are directed towards the input face of the optical element. Additionally, for high efficiency of the lighting module, the input face must intercept a maximum of the light rays emitted by the light source. For this purpose, the light source must be positioned as closely as possible to the input face of the optical element, for example at a distance of less than 0.4 mm. However, to avoid damage to the light sources, it is important to leave a space between the input face of the optical element and the light source. This is because the optical element and the light source would be damaged if the input face of the optical element were to touch the light source.

Furthermore, when the light source is switched on, it produces heat. Because of the proximity of the light source and the optical element, the heat produced by the light source heats up the optical element. The latter then becomes deformed, thus altering the distance between the light source and the input face of the optical element. The relative position of the light source and the input face of the optical element is thus altered. The light rays emitted by the light source then enter the input face of the optical element in a different way, resulting in an alteration of the final light beam.

The document EP2306077 describes lighting modules comprising a light source positioned on a base structure by means of a printed circuit and an optical element retained by means of a support on the base structure, the support and the optical element being made of the same material. Thus, when the light source is activated, it heats both the optical element and its support. The deformation of the optical element is then compensated by the deformation of the support.

One object of the invention is to provide an alternative solution for a lighting module capable of ensuring the position of the optical element relative to the light source and ensuring that the light source is positioned as closely as possible to the input face of the optical element without coming into contact with this face. Another object of the invention is to maintain a substantially constant distance between the light source and the input face of the optical element, independently of temperature variations.

For this purpose, according to the invention, a lighting module of a lighting and/or signalling device for a motor vehicle is provided, comprising:

- at least one light source positioned on a source support
- an optical element comprising an input face which receives light rays emitted by said at least one light source and is positioned facing the latter
- a frame supporting the optical element and fastened to said source support, remarkable in that the optical element has at least one stud having a free end projecting towards the source support, said at least one stud being made of the same material as the optical element and being in direct or indirect contact with the source support when the lighting module is assembled.

"Direct contact" is taken to mean that the stud touches the source support. Therefore there is no intermediate part between the stud and the source support. The optical element is then referenced directly relative to the source support by means of said at least one stud.

"Indirect contact" is taken to mean that the stud comes into contact with an intermediate part which is in contact with the source support. The optical element is then referenced relative to the source support by means of an intermediate part.

Thus, as a result of the present invention, the light source can be positioned relative to the optical element. This is because the stud, regardless of whether it is in direct or indirect contact with the source support, enables the optical element to be referenced relative to the source support, and therefore relative to the light source which is also positioned on the source support.

The stud also enables the distance between the optical part and the light source to be controlled. The light source can therefore be positioned as closely as possible to the input face of the optical element without coming into contact with this face.

The invention also enables a substantially constant distance to be maintained between the light source and the input face of the optical element, independently of temperature variations. This is because, since the optical element and the stud are made of the same material, they are deformed in the same way as a function of temperature variations. Since the stud acts as a referencing device, its deformation compensates for the deformation of the optical element, enabling a constant distance to be provided between the input face of the optical element and the light source.

Advantageously, the distance between the at least one light source and the input face of the optical element is less than 0.4 mm, enabling the input face to intercept most of the light rays emitted by the light source.

Advantageously, the optical element comprises a plurality of studs, for example 2 studs, 3 studs or 4 studs.

Advantageously, the at least one stud is placed on the periphery of the input face of the optical element.

A single stud may be positioned along the whole of the periphery. Alternatively, a plurality of studs may be distributed along the periphery. They may be spaced regularly, meaning that the spaces between two successive studs are identical, or may be spaced irregularly. They may also be distributed symmetrically on either side of an axis of symmetry of the input face of the optical element.

Advantageously, the optical element comprises a plurality of microlenses.

Alternatively, the optical element comprises a plurality of optical guides, each comprising an input face forming said input face of the optical element. The optical guides extend from the optical element in the same direction as the studs. The input faces of the optical guides are thus positioned facing the source support.

The optical element comprises at least as many optical guides as there are light sources. The number of light sources may be less than the number of optical guides. In this case, some optical guides are not associated with any light source. Alternatively, the number of light sources may be equal to the number of optical guides, in which case each optical guide is associated with one light source.

Each of the light sources is associated with an optical guide. The light source with which the optical guide is associated is positioned facing the input face of the optical guide, so that the light rays emitted by each of the light sources enter the optical element through the input face of the optical guide with which it is associated.

According to a first embodiment, the frame comprises a base by means of which it contacts said source support, and the orthogonal projection of the free end of at least one of the studs on a straight line perpendicular to the plane tangent to said base is located farther upstream, or at the same level in the direction of the base, than the projection of the input face of the optical guide which is located farthest downstream in the same direction among all the projections of the input faces of the optical guides. In other words, the ends of the optical guides extend farther in the direction of the base than the studs in projection on a straight line perpendicular to the plane tangent to the base of the frame.

Advantageously, a spacer is in contact with the stud so as to provide a space between the input faces of the optical guides and the light sources. The orthogonal projection of the element formed by the spacer and the stud with which it is associated on a straight line perpendicular to the plane tangent to the base is then located farther downstream in the direction of the base than the projection of the input face of the optical guide which is located farthest downstream in the same direction among all the projections of the input faces of the optical guides. The spacer can thus ensure the correct positioning of the light sources relative to the input face of the optical element. It enables the space between the input face of the optical element and the light sources to be controlled, thus ensuring that a space is maintained between the input face of the optical element and the light sources.

According to a first variant, the spacer is positioned on the source support, the stud bearing on the spacer.

According to a second variant, the spacer is affixed to the end of the stud.

According to a second embodiment, the frame comprises a base by means of which it contacts said source support, and the orthogonal projection of the free end of at least one of the studs on a straight line perpendicular to the plane tangent to said base is located farther downstream in the direction of the base than the projection of the input face of the optical guide which is located farthest downstream in the same direction among all the projections of the input faces of the optical guides. In other words, the ends of the optical guides do not extend as far in the direction of the base as the studs, in projection on a straight line perpendicular to the plane tangent to the base of the frame.

The studs then enable the optical element to be referenced on the source support during assembly, and enable the space between the input face of the optical element and the light sources to be controlled. They ensure that a space is maintained between the input face of the optical element and the light sources.

Advantageously, before the assembly formed by the optical element and the frame is mounted on the source support, each stud is secant to the plane tangent to the base. The contact between the studs and the source support is thus provided for temperatures ranging from −40° C. to 25° C.

If appropriate, the lighting module comprises a resilient joint between the optical element and the frame which can be deformed when the assembly formed by the frame and the optical element is mounted on the source support. The assembly formed by the optical element and the frame may thus be easily assembled on to the source support.

Advantageously, the resilient joint is made of the same material as the optical element. This facilitates the manufacture of the lighting module, since only one material has to be injected to form the optical element and the resilient joint.

Regardless of whether the embodiment is considered singly or combined with the other embodiment, the optical element and the studs are made of a resiliently deformable material. For example, the optical element and the studs may be made of silicone. This material has the advantage of providing good resistance to high temperatures, notably up to 150° C., which are commonly encountered in an environment of a lighting and/or signalling device of a motor vehicle.

Advantageously, the frame is made of a material that is less resiliently deformable than the optical element and the studs. This facilitates the handling and positioning of the light guides facing the light sources.

Advantageously, the frame is made of a material transparent to ultraviolet radiation, to enable the frame to be fastened to the source support with an adhesive that is cured by the action of ultraviolet radiation.

The frame may, for example, be made of polycarbonate (PC), poly(methyl methacrylate) (PMMA), polyurethane (PU) or polyetherimide (PEI).

Advantageously, the coefficient of expansion of the frame is much lower than the coefficient of expansion of the studs, enabling the contact between the studs and the source support to be ensured if the temperature rises.

Advantageously, the studs are made in one piece with the optical element. They may thus be formed at the same time as the optical element. Alternatively, the studs are affixed to the optical element. In this case, they are formed separately and then assembled with the optical element.

Advantageously, the optical element is overmoulded on the frame.

Advantageously, the source support is a printed circuit.

Advantageously, the light sources are light-emitting diodes, also called LEDs, an abbreviation of the English "Light-Emitting Diode".

Advantageously, the frame comprises an interface for fastening the frame to the source support. For example, the frame may comprise one or more openings in which a screw may be positioned. Alternatively, the fastening interface could also be formed by a shoulder of the frame or by a gluing groove on the frame.

Other characteristics and advantages of the present invention will become more readily apparent with the aid of the description and the figures, of which:

Figure 1:
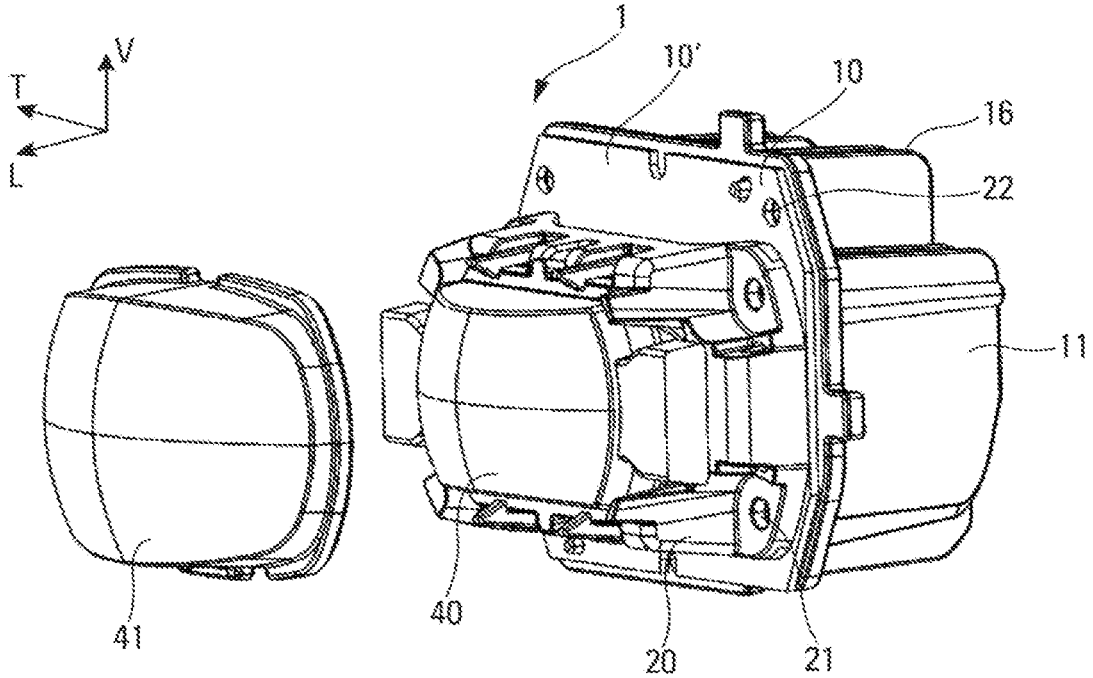
FIG. 1 shows a lighting module according to the invention
Figure 2:
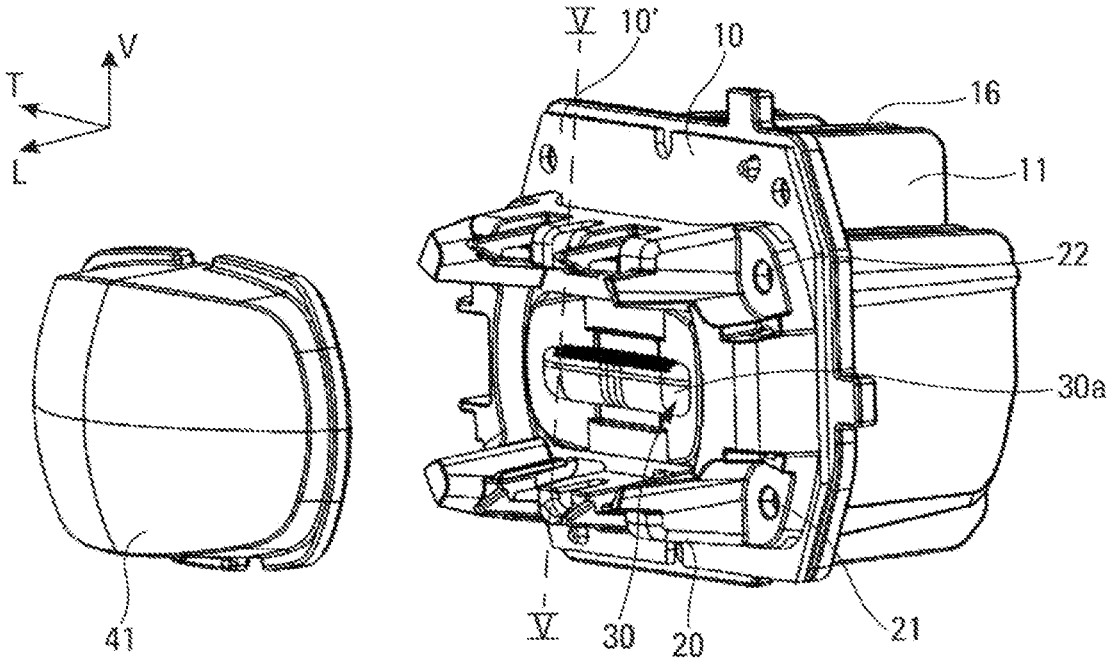
FIG. 2 shows the lighting module of FIG. 1 without its correcting lens
Figure 5:
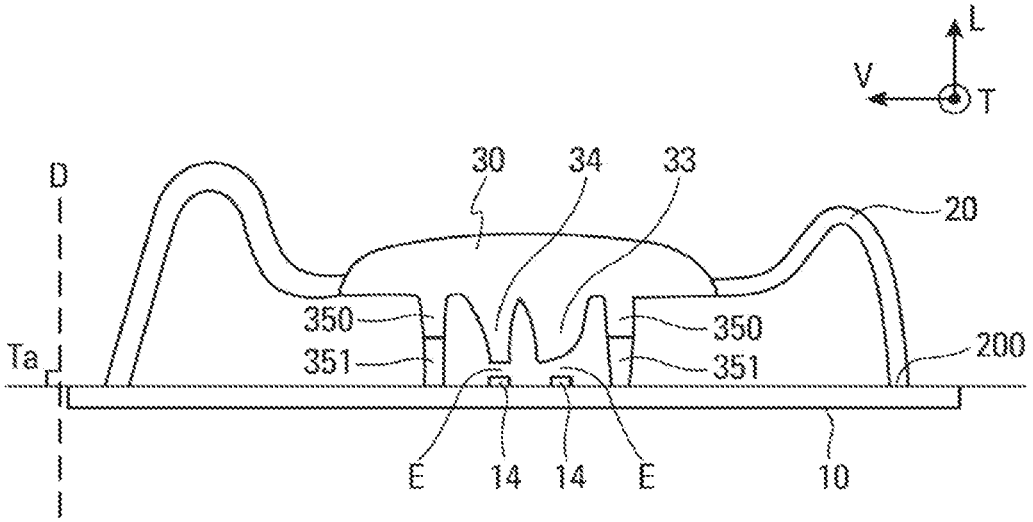
Figure 6:
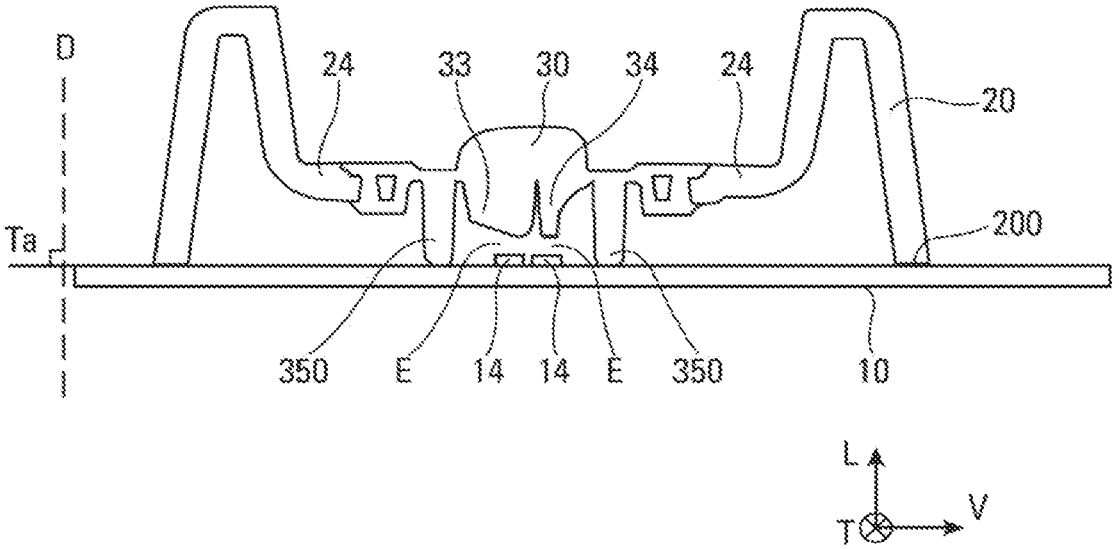
Figure 7:
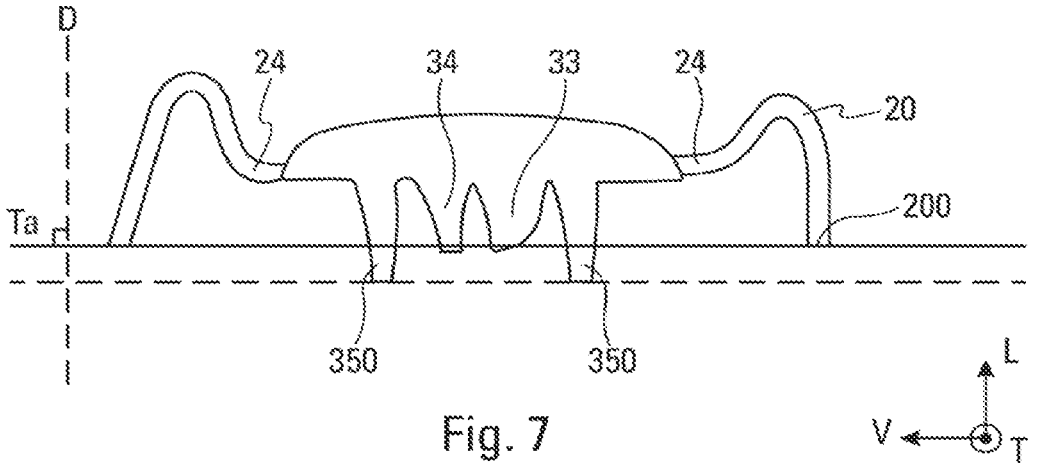
Figure 8:
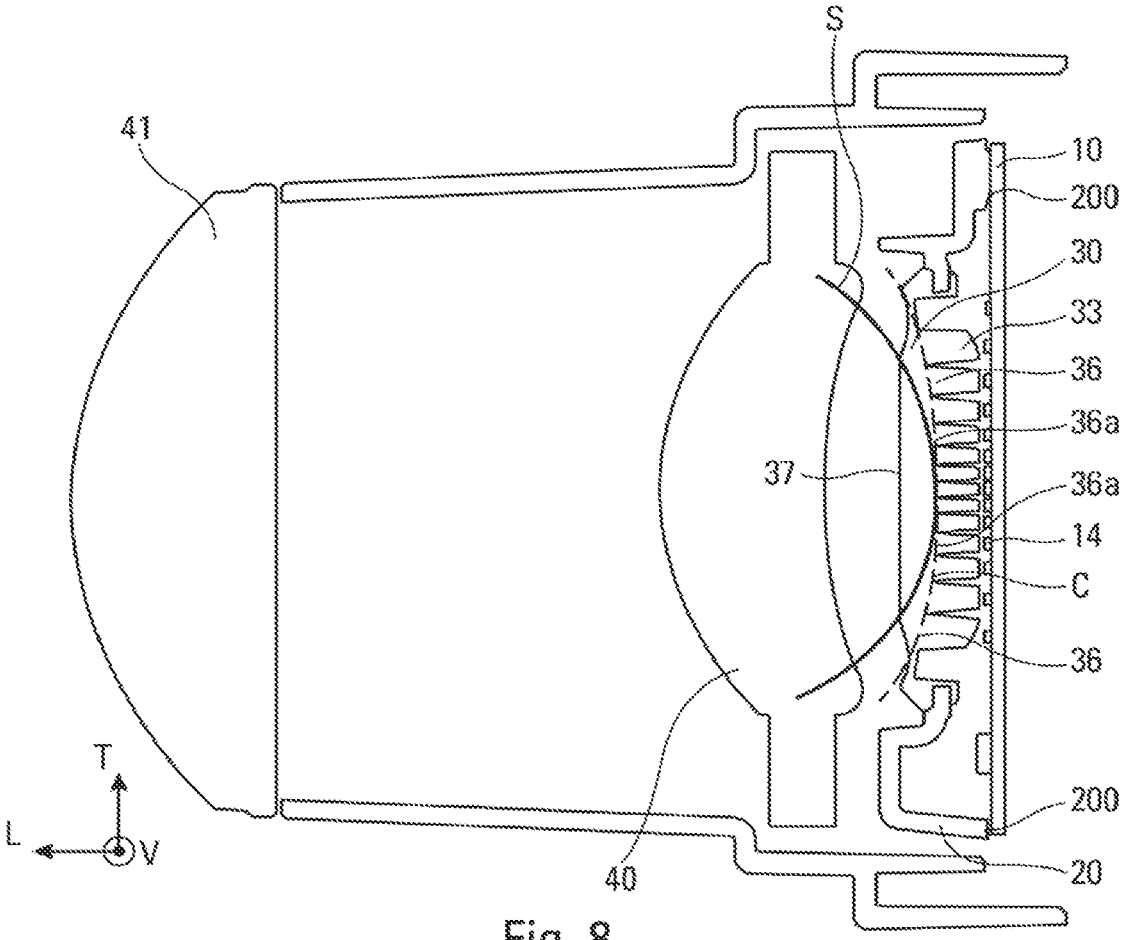

FIG. 5 shows a sectional view of a part of the lighting module taken along the axis V-V shown in FIG. 2, according to a first embodiment of the invention FIG. 6 shows a sectional view of a part of the lighting module taken along the axis V-V shown in FIG. 2, according to a second embodiment of the invention FIG. 7 shows a sectional view of the part shown in FIG. 6 before it is assembled with a source support FIG. 8 shows a sectional view of the lighting module along a lateral vertical section plane In the remainder of the description, the following orientations will be used in a non-limiting way:

longitudinal "L", running from the rear to the front along the optical axis of the projection lens of the lighting module transverse "T", running from left to right vertical "V", running from the bottom to the top FIG. 1 shows a lighting module 1 to be fitted to a lighting or signally device for a motor vehicle. The lighting module 1 is capable of generating a forward light beam.

The lighting module comprises a source support 10 on which a plurality of light sources 14 is positioned. The illustrated source support 10 is here formed by a printed circuit 10'.

Figure 3:
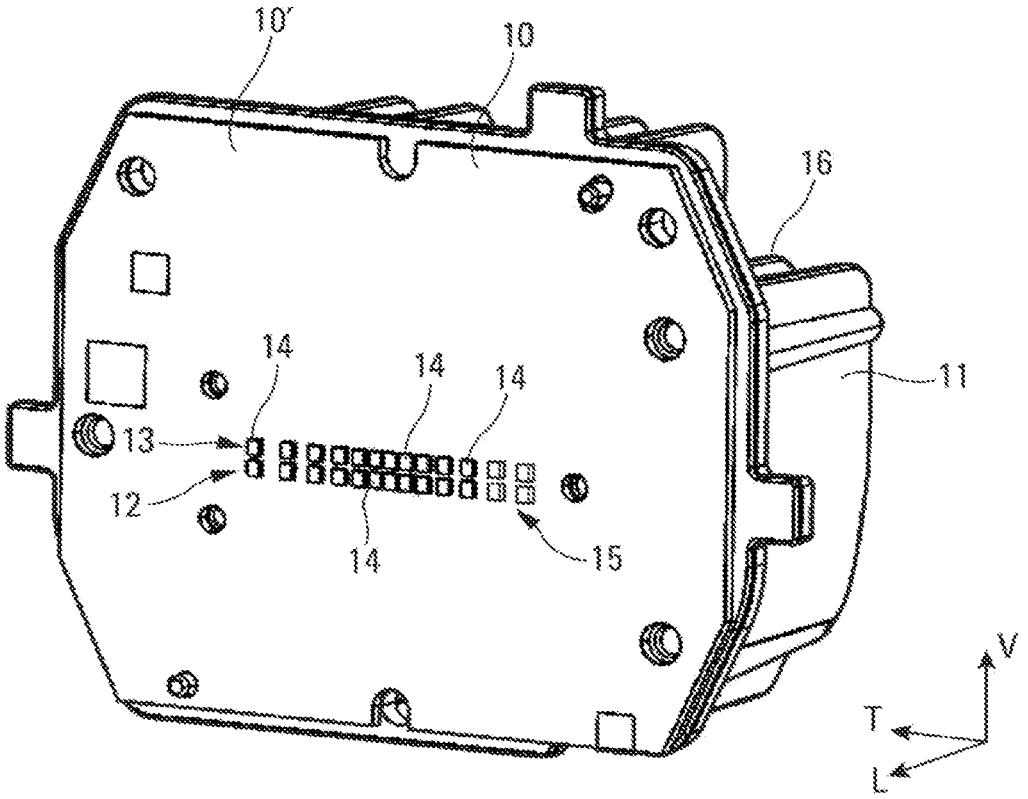
FIG. 3 shows a downstream perspective view of a support of an array of light-emitting diodes

The light sources 14, visible notably in FIG. 3, are distributed along a lower row 12 and an upper row 13. Each row comprises thirteen light sources 14. The superimposition of the two rows thus forms an array 15 of light sources 14.

The light sources are light-emitting diodes.

The array 15 of light sources 14 extends in a plane orthogonal to the longitudinal direction "L". The light sources 14 are carried by the front face of the source support 10.

The light sources 14 are liable to emit heat during their operation. The source support 10 on which the light sources 14 are positioned is positioned on a heat sink 11. The heat sink 11 comprising a plurality of fins 16 extending in the direction opposed to the source support 10 thus enables the heat emitted by the light sources 14 to be dissipated.

The light sources 14 emit light rays. These light rays must be shaped so that the optical module can project a light beam on to the road.

For this purpose, the optical module 1 has an optical element 30 capable of receiving the light rays issuing from the light sources 14. To ensure that the light rays are correctly shaped, the light sources 14 must be positioned in a precise way relative to the optical element 30. The position of the optical element relative to the source support is established by means of a frame 20.

The frame 20 may be used to hold the optical element 30. The frame 20 has a central hole around which the optical element 30 is overmoulded. The frame also has three openings 21, 22, 23 in which a screw can be positioned so as to form a fastening interface between the frame 20 and the source support 10. The frame 20 can then be fastened to the source support 30 by means of screws (not shown) which are inserted into the openings 21, 22, 23. Alternatively, the fastening interface could be formed by a shoulder of the frame 20 or by a gluing groove on the frame 20.

The frame 20 comprises a base 200 by means of which it contacts the source support 10.

Figure 4:
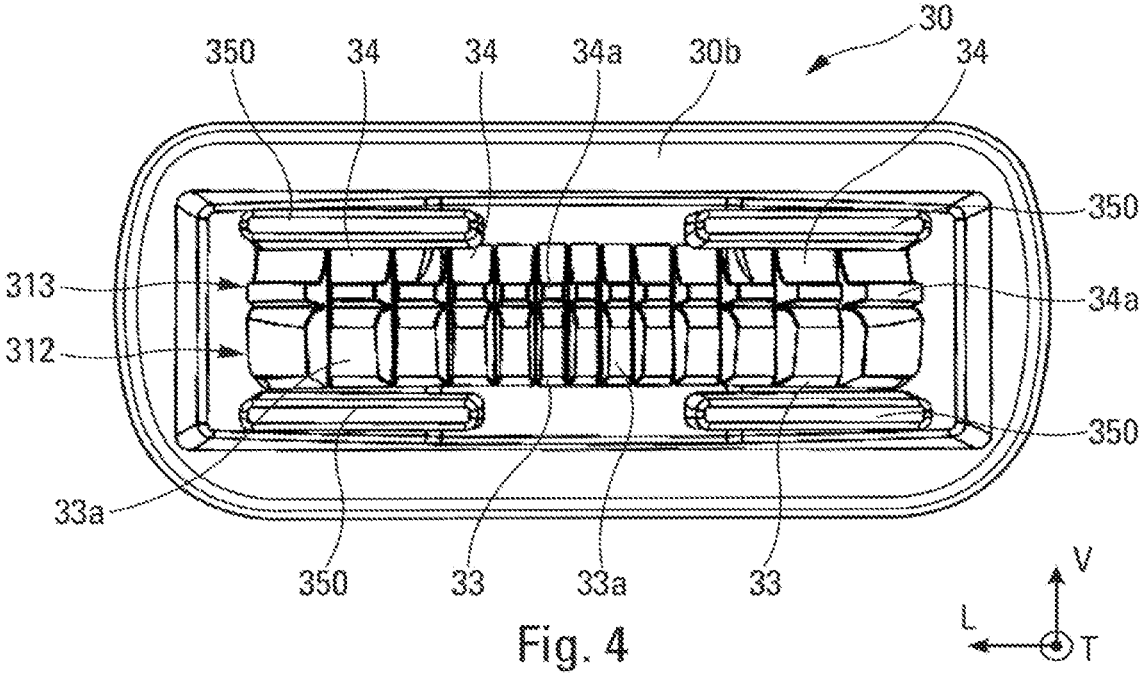
FIG. 4 shows an upstream perspective view of the rear of an optical element forming part of the lighting module of FIG. 1

The optical element 30 comprises a front portion 30*a* visible in FIG. 2 and a rear portion 30*b* visible in FIG. 4. The rear portion 30*b* is formed by a plurality of optical guides 33, 34. As is visible in FIG. 8, the optical guides 33, 34 extend along a main longitudinal axis from an input face 33*a*, 34*a* to a front end output face 36*a* for the light rays. Each light guide is designed to guide the light rays entering through the input face 33*a*, 34*a*, to the front end face 36*a*. The set of input faces 33*a*, 34*a* of the optical guides 33, 34 thus forms the input face of the optical element 30, and each front end face 36*a* forms a secondary light source 36.

The rear portion 30*b* comprises as many optical guides 33, 34 as there are light sources 14. In the illustrated example, the rear portion 30*b* comprises as many optical guides 33, 34 as the number of light sources 14 in the lighting module 1. The rear portion 30*b* comprises a lower row 312 comprising thirteen optical guides 33 and an upper row 313 comprising thirteen optical guides 34. Each optical guide 33 of the lower row 312 is associated with a light source 14 of the lower row 12, and each optical guide 34 of the upper row 313 is associated with a light source 14 of the upper row 13.

The light source 14 with which the optical guide 33, 34 is associated is positioned facing the input face 33*a*, 34*a* of the optical guide 33, 34. The input face 33*a*, 34*a* of the associated optical guide 33, 34 then intercepts the light rays emitted by the light source 14 with which it is associated.

Alternatively, the optical element 30 comprises a plurality of microlenses.

The input faces 33*a*, 34*a* of the light guides 33, 34 are arranged in a common plane which is parallel to the plane of the source support 10. When the optical element 30 is arranged in the optical module 1, each input face 33*a*, 34*a* of the optical guides 33, 34 is positioned facing and close to an associated light source 14, so that most of the light rays emitted by each light source 14 enter the associated optical guide.

Each optical guide 33, 34 has a cross section adapted to produce an elementary outgoing light beam having the desired shape to perform the function of the optical module fitted to the lighting or signalling device.

The front end faces of the optical guides 33, 34 forming the secondary light sources 36 are arranged along a curved surface C. The optical guides 33, 34 located towards the outside of the optical element 30 are thus longer than the optical guides 33, 34 located in the centre of the optical element 30.

In a variant, the front end faces of the optical guides 33, 34 could be arranged in a common plane.

The front end faces of the optical guides 33, 34 thus form an array of secondary light sources 36 which emit elementary light beams. These elementary light beams are shaped by the front portion 30*a* of the optical element 30. This front portion 30*a* makes it possible, for example, to spread the elementary light beams vertically and/or horizontally.

The front portion 30*a* comprises a common front end face 37 for the output of the light rays from the optical element 30.

The front portion 30*a* is made in one piece with the optical guides 33, 34 so that the optical element 30 is a single-unit element.

The lighting module 1 also comprises a projection lens 41 arranged longitudinally in front of the optical element 30 at a distance therefrom. The projection lens is capable of projecting the secondary light sources formed by the optical guides towards infinity to form the final light beam.

The projection lens comprises an object focal surface S. This focal surface has a concave spherical deformation of curvature. This deformation is called a Petzval field aberration.

To ensure that the resulting final beam has the desired light characteristics for its use, the secondary light sources must be imaged sharply. For this purpose, each secondary light source must be located on the object focal surface of the projection lens 41.

To enable the projection lens 41 to be correctly focused on the secondary light sources 36, a field correction lens 40 is interposed between the optical element 30 and the projection lens 41. This field correction lens 40 is designed to correct part of the field curvature aberration of the projection lens 41, the other part of the field curvature aberration of the projection lens 41 being corrected by the curvature formed by the secondary light sources 36.

The field correction lens 40 is shaped so that the image of the object focal surface S curved by the field correction lens 41 extends in an object focal plane coinciding with the curved emission surface C of the array of secondary light sources 36.

The rear portion 30*b* of the optical element 30 comprises four studs 350 each having a free end project towards the source support 10. The other end of each of the studs 350 is made in one piece with the optical element 30. The studs are thus made as a single unit with the optical element 30.

The studs 350 are distributed along the periphery of the input face of the optical element 30. The studs 350 are positioned symmetrically on either side of a transverse axis passing through the middle of the input face of the optical element 30 and on either side of a vertical axis passing through the middle of the input face of the optical element 30.

Without limiting the invention, provision could be made to have another number of studs, and/or to position the studs differently on the periphery of the input face of the optical element 30.

Here, each of the studs 350 has the same length. In a variant, it would be possible to have studs of different lengths.

The distribution of the studs 350 on the periphery of the input face of the optical element 30 permits the distribution of the bearing points of the optical element 30 on the source support 10. This is because, during assembly, the studs 350 come into direct or indirect contact with the source support 10.

According to a first embodiment shown in FIG. 5, the studs 350 come into indirect contact with the source support 10.

The orthogonal projection of the free ends of the studs 350 on a straight line D perpendicular to the plane Ta tangent to the base 200 is located farther upstream or at the same level in the direction of the base 200 relative to the projection of the input face of the optical guide which is located farthest downstream in the same direction among all the projections of the input faces 33*a*, 34*a* of the optical guides 33, 34.

The studs 350 are then farther away from the source support 10 than the input faces 33*a*, 34*a* of the optical guides 33, 34.

The studs 350 each come into contact with a spacer 351 which is in contact with the source support 10. The optical element 30 is then referenced relative to the source support 10 by means of the spacers 351.

The orthogonal projection of the element formed by a spacer 351 and the stud 350 with which it is associated on a straight line D perpendicular to the plane Ta tangent to the base 200 is then located farther downstream in the direction of the base 200 than the projection of the input face of the optical guide which is located farthest downstream in the same direction among all the projections of the input faces 33*a*, 34*a* of the optical guides 33, 34.

The spacers 351 thus ensure that a space E is maintained between the light sources 14 and the input faces 33*a*, 34*a* of associated optical guides 33, 34, while enabling this space E to be minimized so that a maximum of the light rays issuing from the light sources 14 enters through the input face 33*a*, 34*a* of the associated optical guide 33, 34. This separation may, for example, be chosen to be less than 0.4 mm.

The spacers 351 may be positioned on the source support 10, each stud 350 then bearing on a spacer 351. Alternatively, the spacers 351 may be affixed to the ends of the studs 350. The assembly formed by the studs 350 and the spacers 351 enables the optical element to be positioned relative to the source support 10. Thus the light source 14 can be positioned as closely as possible to the input face of the optical element without coming into contact with this face.

According to a second embodiment shown in FIGS. 6 and 7, the studs 350 come into direct contact with the source support 10.

The orthogonal projection of the free ends of the studs 350 on a straight line D perpendicular to the plane Ta tangent to the base 200 of the frame 20 is located farther downstream in the direction of the base 200 than the projection of the input face of the optical guide which is located farthest downstream in the same direction among all the projections of the input faces 33*a*, 34*a* of the optical guides 33, 34.

The studs 350 are then closer to the source support 10 than the input faces 33*a*, 34*a* of the optical guides 33, 34. The studs 350 come into contact with the source support 10 and then enable a space to be maintained between the input faces 33*a*, 34*a* of the optical guides and the source support 10. The distance between the source support 10 and the input faces of the optical guides is therefore controlled by the length of the studs 350.

Additionally, the length of the studs 350 is calculated so that this space is greater than the height of the light sources 14 considered in orthogonal projection on to the same straight line D perpendicular to the plane Ta tangent to the base 200. Thus a space E is provided between the light sources 14 that are positioned on the source support 10 and the input faces 33*a*, 34*a* of the associated optical guides 33, 34. This space E is also such that a maximum number of the light rays issuing from the light sources 14 enters through the input face 33*a*, 34*a* of the associated optical guide 33, 34. This separation may, for example, be chosen to be less than 0.4 mm.

According to this embodiment and in the illustrated example, each stud 350 is secant to the plane Ta tangent to the base 200 of the frame 20, before the assembly formed by the optical element 30 and the frame 20 is mounted on the source support 10. This is, notably, visible in FIG. 7.

The lighting module 1 comprises a resilient joint 24 between the optical element 30 and the frame 20, which can be deformed when the assembly formed by the frame 20 and the optical element 30 is mounted on the source support 10. This resilient joint 24 then enables the element formed by the frame 20 and the optical element 30 to be positioned on the source support 10 without deforming the optical element 30, and notably without damaging the optical guides 33, 34.

In a variant in which the studs 350 had different lengths, it would be feasible to combine the two embodiments so that some studs 350 would be in indirect contact with the source support, via a spacer, and other studs 350 would be in direct contact with the source support.

Additionally, in each of the embodiments, the studs 350 are made of the same material as the optical element 10.

Thus, when the light sources 14 are switched on and produce heat, the optical element 30 and the studs 350 are deformed in the same way as a function of the temperature variations. The deformation of the optical element 30 is therefore compensated by the deformation of the studs 350. Thus, a substantially constant distance may be maintained between the input face of the optical element 30 and the light sources 14, independently of temperature variations.

The optical element 30 and the studs 350 are made of a resiliently deformable material, for example silicone. In the present invention, "resiliently deformable" is taken to mean that the material is deformed without breaking when it is subjected to a stress force. It is therefore flexible.

According to another example, they could be made of polycarbonate, poly(methyl methacrylate) (PMMA), or any other material suitable for making optical guides 33, 34.

Additionally, in the second embodiment, the resilient joint 24 is advantageously made of the same material as the optical element 30 and the studs 350. Thus, when the light sources 14 are switched on and dissipate heat, the optical element 30, the studs 350 and the resilient joint 24 undergo the same deformation, which helps to keep the distance between the light sources 14 and the input faces 33*a*, 34*a* of the optical guides 33, 34 substantially constant.

The frame 20 is made of a less resiliently deformable material than the optical element and the studs, and can thus ensure the correct fastening of the element formed by the frame 20 and the optical element 30 to the source support 10 and facilitate the positioning of the optical guides 33, 34 facing the light sources 14. In particular, the coefficient of expansion of the frame 20 is much lower than the coefficient of expansion of the studs 350.

The invention claimed is:

1. A lighting module, comprising:

at least one light source positioned on a mounting surface of a source support;

an optical element comprising an input face which receives light rays emitted by said at least one light source and is positioned facing said at least one light source: and a frame supporting the optical element and fastened to said source support, wherein the optical element has at least one stud having a free end projecting towards the source support, said at least one stud being made of the same material as the optical element, and wherein when the lighting module is assembled, said free end is in direct contact with the mounting surface of the source support, or said free end is in indirect contact with the mounting surface of the source support via an intermediate part that is positioned between said free end and the mounting surface of the source support.

2. The lighting module according to claim 1, wherein the distance between the at least one light source and the input face of the optical element is less than 0.4 mm.

3. The lighting module according to claim 2, wherein the optical element comprises a plurality of studs.

4. The lighting module according to claim 2, wherein the at least one stud is placed on a periphery of the input face of the optical element.

5. The lighting module according to claim 2, wherein the optical element comprises a plurality of optical guides, each comprising an input face forming said input face of the optical element, and in that the optical element also comprises at least as many optical guides as there are light sources, each of the light sources being associated with an optical guide so that light rays emitted by said light source enter the optical element through the input face of the optical guide with which said light source is associated.

6. The lighting module according to claim 2, wherein the optical element and the studs are made of a resiliently deformable material.

7. The lighting module according to claim 2, wherein the frame is made of a less resiliently deformable material than the optical element and the studs.

8. The lighting module according to claim 2, wherein the coefficient of expansion of the frame is much lower than the coefficient of expansion of the studs.

9. The lighting module according to claim 1, wherein the optical element comprises a plurality of studs.

10. The lighting module according to claim 1, wherein the at least one stud is placed on a periphery of the input face of the optical element.

11. The lighting module according to claim 1, wherein the optical element comprises a plurality of optical guides, each comprising an input face forming said input face of the optical element, and in that the optical element also comprises at least as many optical guides as there are light sources, each of the light sources being associated with a respective optical guide so that light rays emitted by said light source enter the optical element through the input face of the optical guide with which said light source is associated.

12. The lighting module according to claim 11, wherein the frame comprises a base by means of which the frame contacts said source support, and an orthogonal projection of the free end of at least one of the studs on a straight line D perpendicular to a plane Ta tangent to said base is located farther upstream, or at the same level, in the direction of the base, relative to a projection of the input face of the optical guide which is located farthest downstream in the same direction among all the projections of the input faces of the optical guides.

13. The lighting module according to claim 12, wherein a spacer is in contact with the stud so as to provide a space between the free ends of the optical guides and the light sources.

14. The lighting module according to claim 11, wherein the frame comprises a base by means of which the frame contacts said source support, and an orthogonal projection of the free end of at least one of the studs on a straight line D perpendicular to a plane Ta tangent to said base is located farther downstream in the direction of the base than a projection of the input face of the optical guide which is located farthest downstream in the same direction among all the projections of the input faces of the optical guides.

15. The lighting module according to claim 14, wherein each stud is secant to the plane Ta tangent to the base before the assembly formed by the optical element and the frame is mounted on the source support.

16. The lighting module according to claim 15, wherein it comprises a resilient joint between the optical element and the frame, which can be deformed when the assembly formed by the frame and the optical element is mounted on the source support.

17. The lighting module according to claim 16, wherein the resilient joint is made of the same material as the optical element.

18. The lighting module according to claim 1, wherein the optical element and the studs are made of a resiliently deformable material.

19. The lighting module according to claim 1, wherein the frame is made of a less resiliently deformable material than the optical element and the studs.

20. The lighting module according to claim 1, wherein the coefficient of expansion of the frame is much lower than the coefficient of expansion of the studs.

* * * * *